United States Patent [19]

Shakas et al.

[11] Patent Number: 4,941,453

[45] Date of Patent: Jul. 17, 1990

[54] INFANT TRANSITIONAL SENSORY SYSTEM

[76] Inventors: Pauline V. Shakas, 1620 Lasuen Rd., Santa Barbara, Calif. 93103; John S. Woodward, 9295 W. 73rd Pl., Arvada, Colo. 80005

[21] Appl. No.: 822,960

[22] Filed: Jan. 28, 1986

Related U.S. Application Data

[63] Continuation-in-part of Ser. No. 614,717, May 29, 1984, abandoned, which is a continuation-in-part of Ser. No. 371,990, Apr. 26, 1982, abandoned.

[51] Int. Cl.[5] ..... A61B 19/00

[52] U.S. Cl. ..... 600/28; 5/98 B

[58] Field of Search ..... 128/1 C, 33, 64, 135, 128/721; 5/98 B, 120, 122; D36/53

[56] References Cited

U.S. PATENT DOCUMENTS

| | | | |
|---|---|---|---|
| 350,878 | 10/1886 | Fox | 5/120 X |
| 1,071,954 | 9/1913 | Pietilainen | 5/122 |
| 2,220,330 | 11/1940 | Hilger | 5/120 X |
| 2,467,890 | 4/1949 | Harvey | 5/122 |
| 3,235,891 | 2/1966 | Chade et al. | 128/33 X |
| 3,837,019 | 9/1974 | Hoff | 5/105 X |
| 3,994,282 | 11/1976 | Moulet | 128/1 C |
| 4,055,170 | 10/1977 | Nohmura | 128/33 |
| 4,062,586 | 12/1977 | Ortize | 5/120 X |
| 4,066,072 | 1/1978 | Cummins | 128/1 C X |
| 4,124,022 | 11/1978 | Gross | 128/1 C |

FOREIGN PATENT DOCUMENTS

| | | | |
|---|---|---|---|
| 2559329 | 7/1977 | Fed. Rep. of Germany | 128/1 C |
| 1156226 | 5/1958 | France | 5/120 |
| 61555 | 9/1926 | Sweden | 5/122 |

*Primary Examiner*—Edward M. Coven

[57] ABSTRACT

The infant transitional sensory system provides a hammock which may be supported in any of various positions from a deep pocket to a relatively flat or spread position to receive an infant thereon. It includes a sonic device that may be received on and attached to the sheet for generating audible and vibrational impulses simulating the human heart beat. The sheet preferably is of a soft, textured, flexible material, the system providing an enriched environment and substantial tactile kinesthetic stimulation for the newborn to stimulate the normal, full development of the child's primary sensory systems in a uniquely effective, simple fashion.

6 Claims, 2 Drawing Sheets

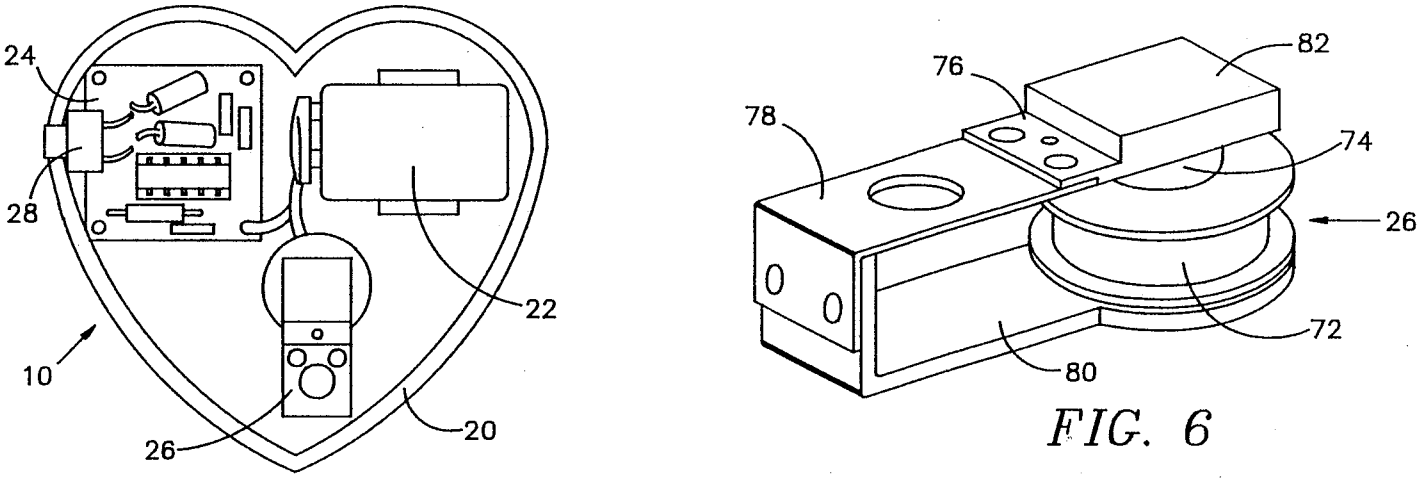
FIG. 4
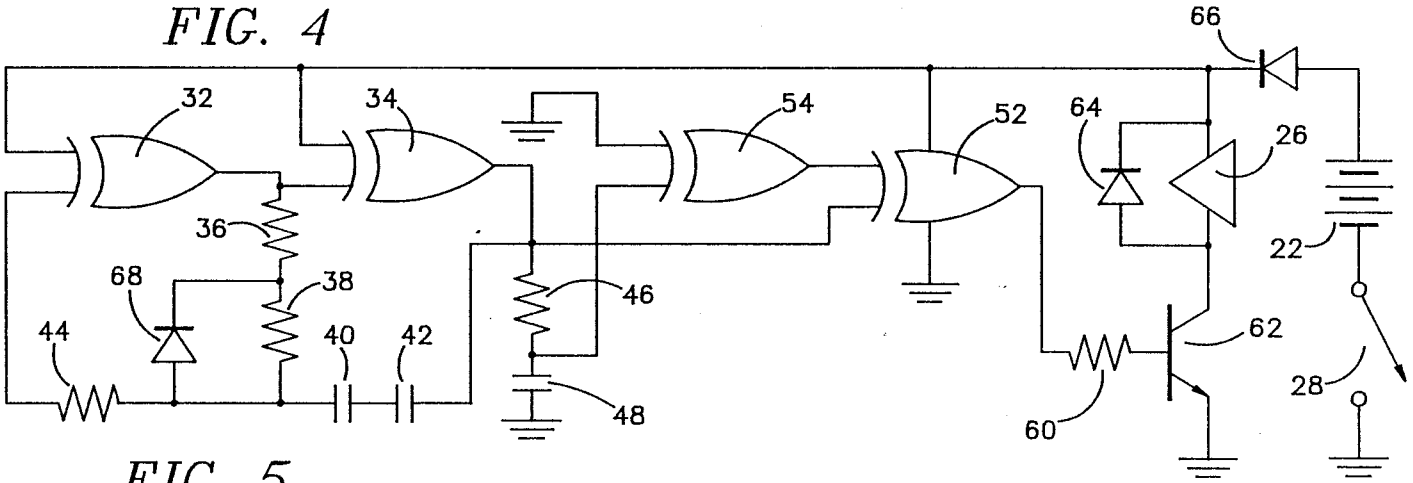
FIG. 5
FIG. 6

INFANT TRANSITIONAL SENSORY SYSTEM

This is a continuation of application Ser. No. 614,717, filed 29 May 1984, which is a continuation of application Ser. No. 371,990, filed 26 April 1982, both now abandoned.

BACKGROUND OF THE INVENTION

1. Field of the Invention

This invention concerns an infant transitional sensory system, one designed to expedite a smooth transition by an infant from the womb to full awareness of the physical world. While it may seem to be deceptively simple, consisting as it does of a hammock-like sheet and a sonic device on that sheet for generating heart beat-like sounds and vibrations, the transitional sensory system addresses basic problems of infant care and offers major advances in such care.

2. Description of the Prior Art

In recent years various psychological studies have shown that the environment and treatment of an infant in the days and months following birth can and do have a major psychological effect in later years of life. In the womb, a fetus has an intimate symbiotic relationship with the mother; it gradually becomes increasingly aware of various sensory stimuli as it develops, but particularly of sounds, touches, movements and its enveloping space. This enriched environment in the womb provides and offers the fetus both a feeling of security and considerable tactile kinesthetic stimulation.

At birth, the rich intrauterine environment is suddenly replaced with a whole new world of sensations. The gamut of stimuli given the fetus before birth suddenly stops. Recent investigations indicate that kinesthetic stimuli such as touching, movement and definition of space, stimuli provided by rocking and cuddling, result in impulses in the infant's nervous system that are directed to the cerebellum to stimulate its development, a process that goes on for at least the first two years of a child's life. Since the cerebellum is the only part of the brain in which brain cell multiplication continues long after birth, this cerebullar stimulation well may be of unique importance. It has been suggested that such stimulation leads to smoothly coordinated muscular efforts in the adult; a ballet dancer represents a high state of cerebullar functioning in which thousands of muscles are controlled with exquisite precision. Kinesthetic stimulation of the infant therefore well may be of primary importance, yet modern baby care practices often prevent just such stimulation. Indeed, many of the products available to parents today are designated to free parents from activities which would provide kinesthetic stimulation for the infant.

The development of the human infant has been described as consisting of two distinct stages of gestation, the first being the nine month period inside the womb, called uterogestation, and the second being the first nine months outside the womb, called exterogestation. During exterogestation infants progress to the point at which they can crawl on all fours. During both stages, stimulation of the infant's primary sensory systems appears to be of great importance; the kinesthetic stimuli provided an infant during exterogestation—the sights, sounds, smells, tastes and warm feelings that comprise the enfolding love that ought to be the birthright of every child—now appears to be of basic importance in the development of a normal, well adjusted human being. To give a few examples, tactile stimulation appears to initiate all innate infant reflexes. Touch is the infant's number one teacher. Not only does it help the infant develop emotional security but actually it appears to also assist the body in development of the brain and nervous system. For this reason, holding the infant, messaging the infant, and providing the infant with different textures to touch are important. Tactile stimulation also seems to have a calming effect on the infant and to assist the infant in organizing its sensory systems, called sensory integration. As another example, handling the infant and providing it with the sensation of movement seems to be vital to the infant's growth, both social, emotional and intellectual. Stimulating the infant's movement sensory system, called the vestibular sensory system, provides the infant with joy and pleasure. Hugging and cuddling the infant develops its emotional security. It also appears to stimulate the thymus gland, a major determinant of the infant's growth and immune systems. Providing the infant with an environment which resists, but yields, to its movement allows the infant to stretch and exercise both its muscular and skeletal systems.

The normal bassinette and crib provided for an infant during exterogestation offers little if any of the necessary stimulation. Since today in many families both parents are employed, and are away from the infant for extended periods only to return home tired and with concerns that compete with the infant for attention, many infants can be deprived of essential sensory stimuli for prolonged intervals. This can lead to long periods of crying by the infant, and to serious psychological problems in later life.

Obviously parents have for centuries been attempting to satisfy the needs of their children, especially in the months following birth. In animals in which the infants are born at an intermediate stage of development, animals such as kangaroos and opossums, the female is equipped with a pouch to provide primary sensory stimuli to the infant during the period of exterogestation. However, while human infants also go through a distinct period of exterogestation, for centuries their parents have placed them in a bassinette or crib and attempted to quickly adapt the infant's natural body rhythms and cycles to the convenience of an adult's schedule. Particularly in recent years this schedule seems to provide less and less tactile kinesthetic stimulation for the infant, a deficiency which is becoming increasingly apparent as a major contributor to serious psychological problems in later life.

3. Objectives of the Invention

A basic object, then, of the Infant Transitional sensory system of the present invention is to provide tactile kinesthetic stimulation for the primary senses of an infant, thereby encouraging and promoting the infant's normal body, brain and psychological development. To attain these objectives has always been of primary importance to parents. It appears that the present invention achieves major advances in this regard. It also has other objectives, and offers other advantages, all of which will be apparent from the following detailed description of a preferred embodiment of the system.

BRIEF SUMMARY OF THE INVENTION

The infant transitional sensory system of the present invention would appear, at first glance, to consist of simply a hammock that includes a sonic device simulating the human heart beat. As will be apparent from the detailed description of the invention, these two components cooperate in a simple yet amazingly effective way to provide an infant during its period of exterogestation with a rich environment of tactile kinesthetic stimulation, particularly for its primary senses. Such an environment is of great benefit in promoting the normal, natural development of the infant.

The hammock comprises a sheet of flexible material that preferably is not only soft but also textured, both to offer tactile stimulation to the infant and to conform and deform to a variety of shapes permitting the infant to move, exercise and define its surrounding space. Support means are provided for the sheet to hold it in various positions from a relatively flat position to a deeply depressed or pocketed position. Thus, the sheet can be positioned to cradle and closely cuddle the infant, permitting a smooth transition from a pocket simulating the cuddling environment of a womb to a more open, flat position in which the infant is exposed to its surrounding environment. Preferably the support system permits the sheet to rock to and fro in response to movement by the infant, thus continuing the sensory stimulation provided by motion that was given the infant during its period of uterogestation. Such stimulation, called vestibular sensory stimulation, excites the infant's nervous system and promotes development of the cerebellum; balance and muscular coordination are enhanced by this stimulation.

Conveniently, the sheet may consist of a panel of stretchable terry cloth material in a polygonal shape, preferably sexagonal, and the support system of straps provided at the corners of the sheet to permit the sheet to be connected to the rails of a crib in any of various configurations. For additional tactile stimulation, the sheet may have a panel of a deep plush pile material on one side. Preferably the sheet also includes a receptical or pocket for the sonic device.

The sonic device of the invention generates both audible and vibratory impulses to well simulate the normal, natural human heart beat. It is self contained in a case and battery powered. Circuit means are included to drive a sonic generator, preferably a solenoid, to thump against the case in a manner simulating the human heart beat, the resulting audible and vibratory impulses being transmitted by the sheet to an infant cuddled thereon. The circuit means to achieve the necessary output sequence for simulation of the human heart beat preferably consists of a series of logic components that are electrically interrelated to produce a pair of closely spaced pulses followed by a delay substantially longer than the interval between the pulses, then another pair of closely spaced pulses followed by a reputation of the longer interval.

The solenoid preferably consist of a coil that is energized by the output of the circuit means to generate a magnetic field in the armature surrounded by the coil and to attract an adjacent, magnetizable plate to the armature. Preferably the configuration and physical characteristics of the solenoid are such that the plate is attracted to the armature with force but not sufficiently to cause the plate to contact the armature. Also, preferably the plate is of a mass sufficient to generate, by its movements towards and away from the armature, vibrations in the case to which the solenoid is attached that are sufficient to produce both audible and tactile impulses.

BRIEF DESCRIPTION OF THE DRAWINGS

The invention will be further described in connection with the accompanying drawings in which:

FIG. 4 is a face view of a preferred sonic device opened to reveal its components;

FIG. 5 is an electrical schematic of a preferred circuit employed in the sonic device; and FIG. 6 is a perspective view of a preferred solenoid sonic generator.

DETAILED DESCRIPTION

Figures 1, 2, 3A, 3B, 3C:
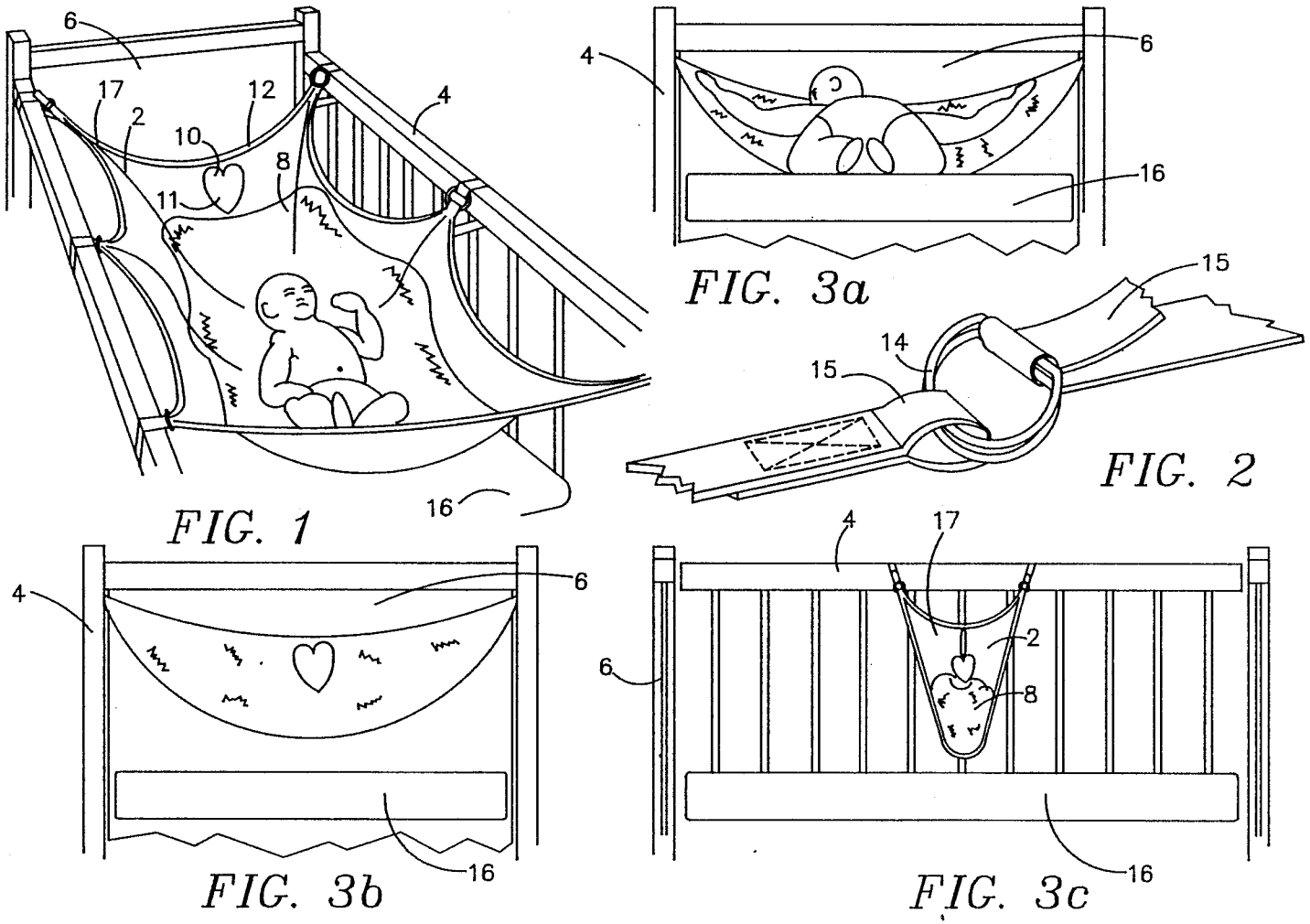
FIG. 1 is a perspective view of the infant transitional sensory system attached to the rails of a typical crib, the crib only being partially shown.
FIG. 2 is a perspective view of the preferred strap or support connection system employed in the present invention, the straps only being partially shown.
FIGS. 3*a*, 3*b*, 3*c* present several elevational views illustrating the range of positions which may be assumed by the system of the present invention.

The infant transitional sensory system provided by the present invention is both simple and effective. It provides, in great measure, an ideal environment for an infant particularly during its period of exterogestation. As is discussed in greater detail subsequently in this application, the components of the system function together to provide the newborn with sufficient tactile kinesthetic stimulation for its primary senses during exterogestation. The infant's senses of touch, movement, space and sound are particularly well stimulated by the cooperation of the components of the system. Sensory integration by the infant is nurtured by the system. The system, in short, offers a uniquely enriched environment for the newborn, one essential to the infant's natural development.

As shown in FIG. 1, the transitional sensory system consists of a sheet 2 attached by support means such as straps 3 to the rails 4 of a crib 6 the sheet thereby assuming a generally catenary shape, both laterally and longitudinally. Preferably sheet 2 is a soft yet textured, flexible material such as stretchable terry cloth to provide an infant with tactile stimulation. By supporting the sheet in a hammock-like configuration, as shown, a central catenary shaped pocket or depression is provided to receive the infant. Preferably sewn in this central area on one side of the sheet is a fuzzy, fur-like deep pile panel 8, the terry cloth sheet and the panel providing the infant with a range of different sensory, tactile stimulation. Such an environment is far different than the flat, hard, cold and relatively smooth surface of the sheet or mattress in the usual crib or bassinette. The importance of tactile stimulation in the development of the infant is described elsewhere in this application.

Preferably a sonic device or generator 10 is received in a pocket 11 sown to the sheet 2. This sonic device generates audible and tactile (or vibratory) impulses simulating the human heart beat, thereby duplicating to a significant extent the dominate, normal and soothing sound patterns received by an infant during its period of uterogestation. Such simulation promotes sound, deep sleep by the infant and well may encourage an appreciation of music in the adult. The sonic device is further described in connection with FIGS. 4 through 6.

Preferably the sheet is polygonal in shape, having relatively flat or arcuate sides terminating in corners, and the support system includes a member of simple, adjustable strap connection devices such as shown in FIG. 2. Conveniently the sheet may be of a hexazonal shape and have six such straps, one at each corner. By cutting the panel with the warp and woof of the material running generally in line with the major longitudinal and transverse axes of the sheet, and by providing arcuate sides between each corner of the sheet, the weight of the infant allows or encourages a bias to develop in the panel and increases resistance of the panel to the infant's movement. Providing corners midway along the length of sheet gives the hammock longer side walls at this point, both for safety and for increased environmental space of the infant, promoting identification by the infant of the surrounding space. Since the portion of the sheet midway between each set of support straps does not change appreciably when the infant is placed on the hammock, preferably the product for the sonic device is located in this area, and the pocket tightly receives the device to better transmit the vibrations to and along the sheet. Also, preferably the edges of the sheet are trimmed with a tape 12, the tape terminating at each corner of the sheet in either a loop section or a strap section.

Presented in FIG. 2 is a perspective view of a portion of a strap 3 illustrating the preferred manner in which the corners of the sheet are adjustably attached to the rails of the crib. Each connection includes a tape loop section 13, formed at one end along the side trim of the sheet, that attaches a pair of rings 14 to a corner of the sheet, and a tape strap section 15 formed at another end of the side trim of the sheet. This strap section may be looped over a rail of the crib and passed around one of the rings and under the other of the rings, as shown, the rings cooperating with the strap to hold yet restrain the strap thereby providing a loop of adjustable size to attach the corner of the sheet to the crib rail. This support means is simple to fasten, yet safe. Increasing tension in the strap section will simply make the rings hold the strap more tightly. The tension of the strap and loop are distributed along the sheet by the side trim 11.

Preferably the size of the sheet, and the length of the strap sections in relation to the crib permits the resulting hammock to be adjusted among various generally catenary shaped positions from a relatively flat, spread position as shown in FIG. *3a*, to a more depressed sleeping position such as shown in FIG. *3b*, to a deep pocket position such as shown in FIG. *3c*. In the deep pocket position of the sheet it may be conveniently connected cross-wise of the crib, the major longitudinal dimension of the sheet extending laterally of the crib, while in the spread position such as shown in FIG. *3a* the sheet may be connected to the rails of the crib with its major longitudinal dimension being parallel to the length of the crib and mattress 16 as illustrated in FIG. 1. Conveniently cooperating strips of velcro 17 or other means of attachment, such as snaps, are provided along the shorter sides of the sheet, as shown, to permit these sides of the sheet to be shortened when the sheet is in the pocket position as shown in FIG. *3c*. This enhances the confinement and cuddling effect provided for the infant when received in the hammock attached to the crib in that deep pocket position. Thus, the hammock can provide a snug enclosure for the infant that is soft, warm, darkened and quiet. It resists movement of the infant, yet stretches and yeilds to permit the infant to move enough for exercise of the skeletal and muscular systems, as well as providing important tactile stimulation for the infant's sense of touch. As the infant grows the position of the sheet and its attachment to the crib can be adjusted to gradually open it from the position shown in FIG. *3c* to the position shown in FIG. *3a*. Recent studies indicate that the resulting cuddling and sensory stimulation can significantly stimulate the infant's growth as well as giving the infant a feeling of security and nurturing the primary sensory systems of the infant to enhance its normal psychological development.

While the sheet is shown as being attached between rails of the crib, of course the support means are simple enough to permit the sheet to be attached to a variety of other support systems, such as for example, between the sides of a porta-crib. Also, preferably the deep pile panel 8 is provided on only one side of the sheet, to permit the sheet to be reversed and the tactile stimulation offered the infant to be varied from time to time. In addition, preferably both the panel 8 and the terry cloth sheet 2 are of a washable material. Since most cribs include side rails that can be raised and lowered relative to the mattress surface 16, when the hammock is in any of its positions, but particularly the spread position illustrated in FIG. *3a*, the position of the rails may be adjusted relative to the mattress to enable the infant to barely touch the mattress as illustrated in FIG. *3a*. This provides for the infant a flat stomach sleeping position, and a gradual transition from the closely enveloping and cuddling position such as illustrated in FIG. *3c* to a spread, more flattened position such as illustrated in FIG. *3a* and then, finally, to a fully flattened position such as may be provided by spreading the sheet flat on the surface of the mattress 16, by simply placing the infant directly upon the mattress 16 as is normally done at present. This results in a gradual and very beneficial transition from the womb to the world during the infant's exterogestational period of development.

The preferred sonic device or generator 10 is illustrated in FIG. 4. As shown there, the components of the sonic device preferably are contained within a heart shaped housing 20 (although obviously any other shape or style of enclosure may be employed, if desired). In FIG. 4 of upper sheet of the housing has been removed to reveal the lower shell and the various components it holds.

In general, the components of the sonic generator include a battery 22, a circuit board 24 bearing the major electrical components of the generator, and a solenoid vibration generator 26 that is attached to the side of the case, as by screws or adhesive, to transmit vibrations to the housing. A switch 28 also may be provided.

The preferred electrical system is schematically illustrated in FIG. 5. It is a simple, "syncopated" circuit. Its operation likely will be readily understood by those skilled in this art from an examination of the schematic. Nevertheless, it functions as follows: the positive potential of battery 22 is applied to bias one of the two inputs to each of exclusive OR gates 32 and 34. Since the other input of gate 32 is at an acquiescent or lower voltage condition, gate 32 will produce a positive output. This output is applied to the other input of gate 34 causing it to produce a zero or grounded output. It is also applied to the series connected resistors 36 and 38, and through them charges capacitors 40 and 42 connected in series. The increasing charge on this chain of capacitors eventually will apply sufficient positive voltage to the input of gate 32 connected thereto through resistor 44 to cause gate 32 to produce a zero or grounded output. This in turn causes gate 34 to now produce a positive output. The positive output of gate 34 is applied through resistor 46 to charge capacitor 48, and is also applied to one input of exclusive or gate 52. As the output of gate 34 charges capacitor 48, eventually the input of exclusive OR gate 54 connected to the junction of resistor 46 and capacitor 48 will receive a sufficient positive voltage to produce a positive output (the other input to gate 54 is grounded and therefore will always be at a zero state). When the output of gate 54 goes positive, gate 52 will cease producing a positive output since both of its inputs will now be positive.

The output of gate 52 is applied through resistor 60 to transistor 62 causing it to conduct current from the battery through the coil of solenoid 26 and to ground. A short time later, on the order of 2–3 milliseconds, when the output of gate 52 drops to zero, transistor 62 will cease conduction. The resulting electromotive force in the coil of solenoid 26 due to the collapse of the magnetic field generates a current that is shunted around the coil by diode 64, to prevent an adverse back bias condition from being applied to transistor 62. Since logic elements can be harmed quite easily by improper application of current, preferably the circuit includes a diode 66 in series with the battery and the various logic elements.

The purpose of the circuit is to, in cooperation with the solenoid vibration generator, produce a thump-thump sound that closely simulates the audible and tactile (vibratory) impulses of the human heart. The sound is characterized by two pulses in rapid succession, then a long or pause, followed again by the two pulses in rapid succession. Each thump is produced by a conduction cycle of transistor 62. To illustrate, a first thump is initiated by conduction of gate 34, causing gate 52 to conduct. A short time later gate 54 conducts. Its output with the output of gate 34, causes gate 52 to terminate conduction. A short time later, gate 32 conducts, and conduction of gate 34 terminates, again causing gate 52 to conduct. Conduction of gate 52 terminates when capacitor 48 is discharged through resistor 46 to the grounded output of gate 34 sufficiently to remove the positive bias to the input of gate 54, causing its output to match the grounded output of gate 34.

The interval between these two conductions cycles is generally determined by the discharge rate of capacitors 40 and 42 through diode 68 and resistor 36 to the grounded output of gate 32. Preferably there is a 0.4 to 0.7 second delay between the resulting two conduction sequences of transistor 62 that have just been described.

At this point, both inputs to gate 34 are positive, and the outputs of gates 34, 52 and 54 are all a zero or grounded state. The positive output of gate 32 resumes charging capacitors 40 and 42 through resistor chain 36 and 38. Preferably the value of these resistors, and particularly resistor 38, is chosen to result in approximately a 1.0–1.2 second delay between the termination of the last described cycle of conduction of transistor 62 and the moment when the positive potential on capacitor 40 reaches a state sufficient, when applied to the other input of gate 32 through resistor 44, to cause gate 32 to cease conduction. This re-initiates the conduction cycle just described.

The conduction state sequence of the four gates during each stage of the sequence just described, termed for convenience stage A, B, C and D, can be diagrammatically represent as follows:

| GATE | A | B | C | D |
|---|---|---|---|---|
| 32 inputs | + | + | + | + |
| | O | + | + | O |
| 32 outputs | + | O | O | + |
| 34 inputs | + | + | + | + |
| | + | O | O | + |
| 34 outputs | O | + | + | O |
| 54 inputs | O | O | O | O |
| | O | O | + | + |
| 54 outputs | O | O | + | + |
| 52 inputs | O | O | + | + |
| | O | + | + | O |
| 52 outputs | O | + | O | + |

The preferred solenoid device 26 is illustrated in FIG. 6. It includes a coil 72 wrapped about a magnetizable armature or core 74, and a magnetizable plate 76 that is attached to a resilient mounting consisting of a spring-like armor panel 78 and a base 80, this mounting holding plate 76 spaced somewhat from the face of core 74. A weight or inertial element 82 may be attached, as by adhesive or any other convenient means, to the outer surface of plate 76.

In operation sequence of pulses generated by the logic system schematically illustrated in FIG. 5 is applied to the solenoid coil 72 to magnetize core 74 and attract plate 76, then to release the plate. The mass or inertia of element 82 impedes the attraction of the plate to the core, and causes the plate 76 to resonate with spring arm 78 somewhat, the impedance and resonation being controlled both by the stage and the duration of the pulses applied to the coil and by the mechanical characteristics of the plate, weight and spring panel, among other things. More particularly, the soleniod when delivered has certain inherent characteristics, among which are the spring constant of its arm 78 and the spacing between the facing surface of plate 76 and solenoid core 74. The electrical circuit is designed to produce a series of pulses, as has been described. To achieve a series of distinct thumps, as is desired, the charactertics of the solenoid and circuit must be appropriately inter-related to achieve substantial movement of the plate yet to avoid causing it to impact upon the solenoid core 74. Should this occur, the resulting sound tends to be simply a click. The inertia provided by weight 82 assist in achieving this objective. Such characteristics conveniently may be adjusted by, for example, slightly bending bar 80 or arm 78 to adjust the spacing between plate 76 and core 74. By appropriately adjusting these characteristics, vibrations can be induced in the housing 20 that closely simulate the thump-thump vibrations of human heart beats.

It is important that the characteristics of the solenoid, and the waveform applied to the solenoid by the circuit, be such that the plate 76 does not.

In the preferred circuit, since by and large mainly logic elements are employed the current drain of the battery 22 is for the most part the current through the coil of solenoid 26 which occurs during conduction of transistor 62. Preferably each interval of conduction is on the order of 2–3 milliseconds. At a rate of 60 pulses a minute, a typical nine volt battery will provide on the order of 800 hours of continuous operation, which is somewhat more than one month.

As has been stated, the sonic device 10 preferably is received in a pocket 12 provided in sheet 2. The resulting vibrations of the sonic device are transmitted through sheet 2 to the infant supported thereby, and cooperate with the characteristics of the sheet to provide an excellent transitional environment for the infant. The sheet cuddles the infant, yet permits the infant to rock, kick and stretch; the sonic generator provides a rythmic heart beat simulating probably the most important sound in the womb, to both calm and reassure the infant.

Thus, the infant transitional sensory system of the present invention promotes and encourages the body, brain and psychological development of the infant during exterogestation by stimulating the body's primary sensory systems, including at least the following basic systems:

(1) The sense of touch-this sense initiates all innate infant reflexes. Touch not only develops emotional security but actually enhances growth of the infant's brain and nervous system. Textures are therefore of basic importance. The terry cloth sheet and pile panel of the system directly and continuously stimulates the tactile senses of the infant.

(2) Sensing sounds, especially familiar, reassuring sounds, also appears to be important to the infant. The infant has come from the womb and an environment in which the constant, rhythmic beat of the mother's heart has given a continual, calming assurance. The sonic device offers both audible and vibrational impulses to the infant, when cuddled in the sheet formed hammock that well simulates this rythmic beat. Studies have shown a dramatic decrease in crying by the infant and a significant weight gain in response to such sounds or impulses. Of course, the sonic device may be used alone after the sheet formed hammock is no longer needed, the device continuing to assurance to the child just stated.

(3) The sense of movement is another of the infant's primary teachers. It also is important in developing the infant's brain and nervous system. The rocking motion permitted by the sheet-formed hammock of the system and stimulated by motion of the infant offers some mobility for the newborn, and in an identifiable curved space similar to that of the womb. The curved shape of the hammock also allows the infant to exercise, to stretch and move against some resistance, in a normal, natural pattern, and in a fashion that can be adjusted by simply adjusting the shape of the hammock provided by the system. Particularly in the deep pocket position provided by the hammock, the movement of the hammock induces a free and restful rocking, a motion that has been shown to calm the infant and to promote a quiet and restful sleep. In fact, this vestibular stimulation in cooperation with the sonic generator has been shown to dramatically reduce, and in some cases almost instantly cure, chronic crying conditions of newborns.

(4) Sensing the surrounding, enveloping space is another of the infant's primary teachers. The newborn infant while in the womb has been in a comfortable, conformable and a confining space; the infant after birth naturally is secure when so held, and even seems to require a continuation of this definition of space during exterogestation. The hammock of the system allows the infant to press and stretch against its sides, to aid in identifying the enveloping space as well as to promote, stabilize and integrate the infant's relationship with and to that space. Further, this shape seems to reduce flailing by the infant (sometimes referred to as a "startle" reflex) which seems to be akin to the sensation of falling, apparently a source of tension and tension-induced colic in many infants.

Thus, the transitional sensory system of the present invention provides an enriched environment that continues all the major stimulants during uterogestation and offers the infant a basic, necessary stimulation during the first vital few months of life in the world. It promotes exercise of the infant's joint and muscle systems as well as the infant's brain and nervous systems. It assists in the integration of the infant's senses, and the infant's relationship to gravity as well. It is a valuable and unique aid, both in the physical development of the infant and in the prevention of a number of psychological disorders that appear to be directly related to the lack of sensory stimulation and integration of the infant.

While a preferred embodiment of the infant transitional sensory system, and of its major components, has been described, it will be apparent to those skilled in this field that numerous variations in the features of the system may be employed. Thus, the invention is defined, not by the disclosed embodiment, but by the following claims.

We claim:

1. In an infant crib or the like having a top railing surrounding the walls of a sleeping area for an infant, the improvement to provide a transitional sensory system for the infant comprising:

(a) a hammock-formable sheet of material;

(b) attachment means disposed at spaced peripheral locations about said sheet of material for attaching said sheet of material to the top railing in at least two configurations wherein one of said configurations places said sheet in a generally extended horizontal position to form a hammock-like surface upon which an infant can be placed and the other of said positions places said sheet in a position with the ends folded back upon one another to form a hanging pouch wherein an infant can be placed;

(c) heart sound simulation means for producing vibrations approximating the thump-thump characteristic heart sounds of a human heart; and, (d) holding means attached to said sheet of material for holding said heart sound simulation means and for transmitting the vibrations produced thereby into said sheet of material and from thence into an infant disposed on said sheet to be sensed by the infant; wherein said heart sound simulation means comprises:

a hollow case;

a solenoid coil disposed within said case;

a battery disposed within said case;

a weighted spring arm disposed within said case and attractable by a magnetic field produced by said solenoid coil, said arm being connected to said case and adapted to move from a central position to which it is biased towards said coil when attracted thereto and to a position stiking said case when no longer attracted towards said coil; and, driver circuit means disposed within said case interruptably connected between said battery and said coil for producing periodic pairs of close-spaced pulses of current through said coil whereby said spring arm is caused to periodically strike said case twice in close-spaced succession thus producing in said case a thump-thump vibration sequence simulating characteristic human heart sounds.

2. The infant sensory system of claim 1 wherein:

said sheet of material and the manner of attachment means thereto is such as to make said material reversible as between which is the top and which is the bottom surface thereof, said reversible top and bottom surfaces respectively having different tactile materials in central areas thereof disposed for the location of an infant thereon.

3. The infant sensory system of claim 1 wherein:

means are provided along side edges of said sheet of material for releasably connecting facing side portions together when said sheet of material is in said hanging pouch configuration whereby said pouch is closed along said side edges to maintain an infant therein.

4. The infant sensory system of claim 1 wherein:

said attachment means are adapted for attaching said sheet of material to the top railing in a plurality of configurations between the extremes of said at least two configurations whereby said sheet can be gradually reconfigured in stages towards said generally extended horizontal position from said hanging pouch position as the infant matures.

5. In an infant crib or the like having a top railing surrounding the walls of a sleeping area for an infant, the improvement to provide a transitional sensory system for an infant comprising:

(a) a hammock-formable sheet of material, said material being reversible as between which is the top and which is the bottom surface thereof, said reversible top and bottom surfaces respectively having different tactile materials in central areas thereof disposed for the location of an infant thereon;

(b) attachment means disposed at spaced peripheral locations about said sheet of material for attaching said sheet of material to the top railing in two configuration extremes wherein one of said configurations places said sheet in a generally extended horizontal position to form a hammock-like surface upon which an infant can be placed and the other of said positions places said sheet in a position with the ends folded back upon one another to form a hanging pouch wherein an infant can be placed, said attachment means further being adapted for attaching said sheet of material to the top railing in a plurality of configurations between the extremes of said two configurations whereby said sheet can be gradually reconfigured in stages towards said generally extended horizontal position from said hanging pouch position as the infant matures;

(c) heart sound simulation means for producing vibrations approximating the thump-thump characteristic heart sounds of a human heart, said heart sound simulation means comprising, (c1) a hollow case;

(c2) a solenoid coil disposed within said case;

(c3) a battery disposed within said case;

(c4) a weighted spring arm disposed within said case and attractable by a magnetic field produced by said solenoid coil, said arm being connected to said case and adapted to move from a central position to which it is biased towards said coil when attracted thereto and to a position stiking said case when no longer attracted towards said coil; and, (c5) driver circuit means disposed within said case interruptably connected between said battery and said coil for producing periodic pairs of close-spaced pulses of current through said coil whereby said spring arm is caused to periodically strike said case twice in close-spaced succession thus producing in said case a thump-thump vibration sequence simulating characteristic human heart sounds; and, (d) holding means attached to said sheet of material for holding said heart sound simulation means and for transmitting the vibrations produced thereby into said sheet of material and from thence into an infant disposed on said sheet to be sensed by the infant.

6. A transitional sensory system for an infant comprising:

(a) a hammock-formable sheet of material;

(b) means for supporting said sheet of material in a generally extended horizontal position to form a hammock-like surface upon which an infant can be placed;

(c) heart sound simulation means for producing vibrations approximating the thump-thump characteristic heart sounds of a human heart, said heart sound simulation means comprising, (c1) a hollow case;

(c2) a solenoid coil disposed within said case;

(c3) a battery disposed within said case;

(c4) a weighted spring arm disposed within said case and attractable by a magnetic field produced by said solenoid coil, said arm being connected to said case and adapted to move from a central position to which it is biased towards said coil when attracted thereto and to a position stiking said case when no longer attracted towards said coil; and, (c5) driver circuit means disposed within said case interruptably connected between said battery and said coil for producing periodic pairs of close-spaced pulses of current through said coil whereby said spring arm is caused to periodically strike said case twice in close-spaced succession thus producing in said case a thump-thump vibration sequence simulating characteristic human heart sounds; and, (d) holding means attached to said sheet of material for holding said heart sound simulation means and for transmitting the vibrations produced thereby into said sheet of material and from thence into an infant disposed on said sheet to be sensed by the infant.

* * * * *